US005914296A

United States Patent [19]

Shen

[11] Patent Number: 5,914,296

[45] Date of Patent: Jun. 22, 1999

[54] RESONATORS FOR HIGH POWER HIGH TEMPERATURE SUPERCONDUCTING DEVICES

[75] Inventor: Zhi-Yuan Shen, Wilmington, Del.

[73] Assignee: E. I. du Pont de Nemours and Company, Wilmington, Del.

[21] Appl. No.: 08/790,971

[22] Filed: Jan. 30, 1997

[51] Int. Cl.[6] ..... H01P 7/00; H01B 12/02

[52] U.S. Cl. ..... 505/210; 505/700; 505/701; 505/866; 333/995; 333/219; 333/235; 333/204

[58] Field of Search ..... 333/204, 205, 333/219, 235, 996; 505/210, 700, 701, 866

[56] References Cited

U.S. PATENT DOCUMENTS

| | | | |
|---|---|---|---|
| 4,749,963 | 6/1988 | Makimoto et al. | 333/219 X |
| 5,172,084 | 12/1992 | Fiedziuszko et al. | 333/204 |
| 5,534,831 | 7/1996 | Yabuki et al. | 333/219 X |

FOREIGN PATENT DOCUMENTS

| | | | |
|---|---|---|---|
| 0 516 145 A1 | 12/1992 | European Pat. Off. . | |
| 2152857 | 4/1973 | Germany | 333/219 |
| 1277255 | 12/1980 | Russian Federation | 333/204 |

OTHER PUBLICATIONS

Nagai, Y, et al; "Properties Of Disk Resonators And End Coupled Disk Filters With Superconductive Film"; Jpn. J. Appl. Phys; vol. 32, Part 1, Vil 12A; Dec. 1993; pp. 5521–5531.

Y. S. Wu et al., Mode Chart for Microstrip Ring Resonators, *IEEE Transactions on Microwave Theory and Techniques*, 487–489, Jul. 1973.

C. M. Chorey et al., YBCO Superconducting Ring Resonators at Millimeter–Wave Frequencies, *IEEE Transactions on Microwave Theory and Techniques*, 39, No. 9, 1480–1487, Sep. 1991.

R. Jansen, High–Order Finite Element Polynomials in the Computer Analysis of Arbitrarily Shaped Microstrip Resonators, *Archiv Der Elektrischen Ubertragung*, 30, No. 2, 71–79, 1976.

V. K. Tripathi, Perturbation Analysis and Design Equations for Open—and Closed–Ring Microstrip Resonators, *IEEE Transactions on Microwave Theory and Techniques*, 32, No. 4, 405–410, 1984.

U. Hiroki et al., (Kyocera Corp.), Oscillation Circuit, *Patent Abstracts of Japan*, Publication No. 05335834, Dec. 17, 1993.

Shen, Z–Y. High Temperature Superconducting Microwave Circuits, Artech House, Boston, p. 113 (1994).

*Primary Examiner*—Benny T. Lee

[57] ABSTRACT

$TM_{0i0}$ mode (i=1, 2, 3, . . . ) planar high temperature superconductor resonators useful in high temperature superconducting filters, filter banks and multiplexers comprise a shaped high temperature superconductor film and a high temperature superconductor ground plate deposited on opposite sides of a dielectric substrate, wherein the shaped high temperature superconductor film has an aperture in the center thereof and has a shape selected from the group consisting of circles and polygons.

4 Claims, 10 Drawing Sheets

$TM_{010}$ mode $TM_{020}$ mode $TM_{030}$ mode $TM_{010}$ mode $TM_{020}$ mode $TM_{030}$ mode 80b
82a
83a 87a
88a 85
86
84
80d 88b
87b 83b
82b
80f
8b
8c
8d
8e
8f 81a
81b
80a
80b
80c
80d
80e
80f

RESONATORS FOR HIGH POWER HIGH TEMPERATURE SUPERCONDUCTING DEVICES

BACKGROUND OF THE INVENTION

This invention is directed to $TM_{0i0}$ mode (i=1, 2, 3, . . . ) circular and polygon shaped planar high temperature superconductor resonators having a hole in the center thereof, and their applications to high temperature superconducting filters, filter banks and multiplexers.

Filter banks and multiplexers are widely used in telecommunications as channelizers, which separate or combine the incoming signals according to their frequencies. The basic building block of filters banks and multiplexers is a filter, which comprises a number of resonators as the frequency selecting element. For applications in telecommunication, the filters need to have narrow bandwidth, accurate center frequency, low insertion loss in the in-band, high rejection in the off-band, steep skirts at the edges of the in-band, compact size and high power handling capability. Conventional filters made from normal conductors are not well suited for telecommunication uses because of the high loss in the normal conductors.

High temperature superconductors (HTS) planar filters have been made with excellent performance at low power. See Zhi-Yuan Shen, *High Temperature Superconducting Microwave Circuits*, Artech House, Boston, 1994, p. 113. While these HTS planar filters have utility in receivers, due to their very limited power handling capability, they are not well suited for use in transmitters. For application in transmitters, the filters must handle power ranging from ten watts to hundreds of watts. In commonly assigned, U.S. Pat. No. 5,710,105, we disclose $TM_{0i0}$ mode (i=1, 2, 3, . . . ) circular and polygon shape HTS filters, filter banks and multiplexers which are capable of handling more than 100 watts of transmitting power.

The center frequency accuracy is another important requirement, particularly for a narrow band filter. This is especially true for the filters in the so called "contiguous" multiplexer, such as that described in Zhi-Yuan Shen, supra at page 120, and in a multi-pole filter, where loss of center frequency accuracy will severely degrade performance. Unfortunately, the frequency of HTS resonators in a filter may deviate from the design value due to circuit fabrication tolerances and the uncontrollable variations in the substrate such as the thickness changes or "twin boundary." See Zhi-Yuan Shen, supra at 12.

In commonly assigned, copending application Ser. No. 08/227,437, filed Apr. 14, 1994, now abandoned, we disclose planar HTS filters in a "stacked form", in which the individual HTS resonators are stacked vertically and coupled via holes or slots in the ground plates. Coupling, however, is only provided between adjacent resonators. Certain type of filters, such as the "elliptical frequency response" bandpass filter, require "jump-over" coupling, that is, coupling between resonators that are spaced from each other by one intermediate resonator.

SUMMARY OF THE INVENTION

Basically speaking, the invention comprises $TM_{0i0}$ mode planar high temperature superconductor resonator, where i is a whole integer≧1, comprising a shaped high temperature superconductor film and at least one high temperature superconductor around plate deposited on opposite sides of at least one dielectric substrate; wherein the shaped high temperature superconductor film has an aperture in the center thereof and has a shape selected from the group consisting of a circle and a polygon. In a microstrip line form embodiment, the resonators comprise a single ground plate and a single dielectric substrate. In a strip line form, two substrates, each having a ground plate deposited thereon, are used and the shaped high temperature superconductor film is sandwiched between the substrates to form resonator having a ground plate/substrate/HTS film/substrate/ground plate structure.

The resonators are particularly useful in frequency tuning, that is, changing the resonator frequency to optimize the performance of the filter and in providing jump-over coupling between next-to-adjacent resonators for filters with elliptical frequency response.

DETAILED DESCRIPTION OF THE EMBODIMENTS

In a broad sense, the present invention comprises a planar $TM_{0i0}$ mode (where i is a whole integer≧1) HTS resonator comprising a circular or polygonal HTS film, the film having a centrally located aperture and at least one ground plate deposited on at least one substrate. Circular and octogon shapes are preferred for the HTS film. The aperture can be circular or polygonal and need not be the same shape as the HTS film. The term "circular" as used herein is not to be understood to require a perfect circle. Rather, imperfect circles; that is, circles in which differences in the diameter of the circle are less than 1%, are also included. Similarly, the term "polygon" is to be understood to mean any equal side and equal angle polygons having at least five sides.

Figure 1B:
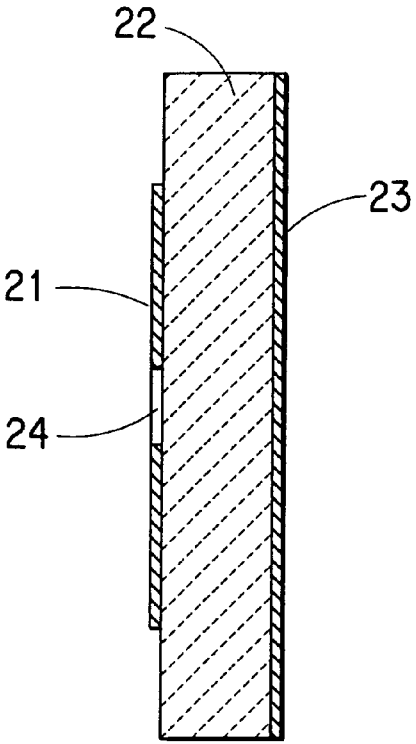
FIGS. 1(*a*)–1(*b*) are schematic illustrations of an embodiment of the $TM_{0i0}$ mode (i=1, 2, 3, . . . ) planar resonator of this invention in the microstrip line configuration, in which FIG. 1(*a*) shows the front view and FIG. 1(*b*) shows the cross sectional view.
Figure 1A:
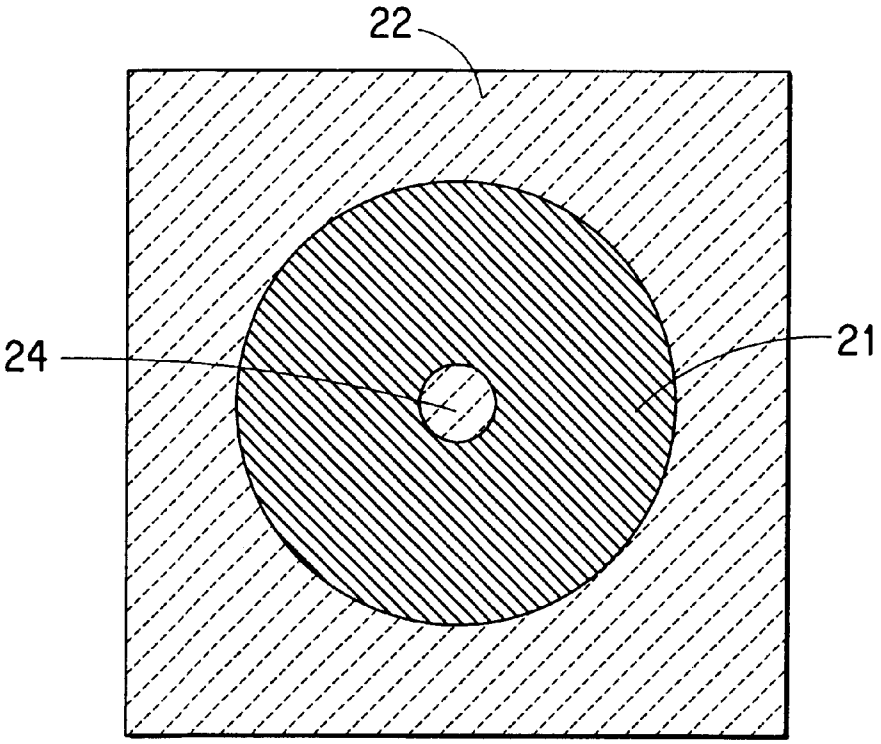

With reference being made to FIGS. 1(*a*) and 1(*b*), one embodiment of a resonator of this invention is illustrated schematically and comprises a circular HTS film 21 having a central aperture 24 therein and an HTS ground plate 23 (See FIG. 1(*b*) deposited on opposite sides of a substrate 22. The HTS materials used for the HTS film and the HTS ground plate are preferably selected from high temperature superconductors with a transition temperature greater than 80° K. and a conductivity one hundred time greater than pure copper. $YBa_2Cu_3O_{7-\delta}$, (where δ ranges from about 0 to 1) $Tl_2Ba_2CaCu_2O_8$ and $(Tl,Pb)Sr_2Ca_2Cu_3O_9$ are most preferred as the HTS materials of choice. The substrate may be any dielectric substrate commonly employed in HTS devices. Most preferred are dielectric materials with a loss tangent less than $10^{-3}$.

Figure 2A:
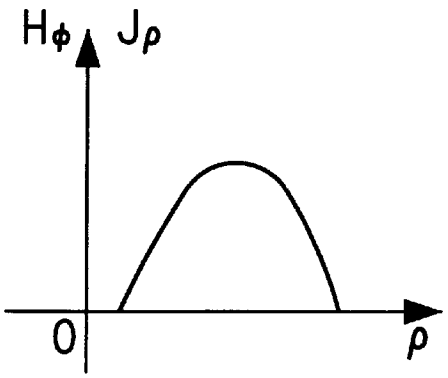
FIGS. 2(*a*)–2(*c*) are graphic representations of the current and the magnetic field distributions of the resonators of this invention operating in the $TM_{0i0}$ mode, $TM_{020}$ mode, and $TM_{030}$ mode as shown in FIG. 2(*a*), FIG. 2(*b*), and FIG. 2(*c*), respectively.
Figure 2B:
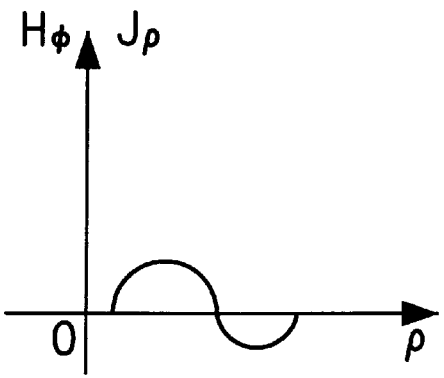
Figure 2C:
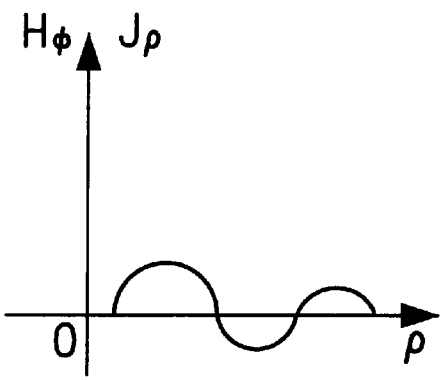

With reference now being made to FIGS. 2(*a*), 2(*b*) and 2(*c*) illustrated therein are graphic representations of the radial direction current Jρ and the circular direction magnetic field Hϕ as functions of the radial distance ρ from the center of the resonator of this invention operating in the $TM_{010}$ mode (FIG. 2(*a*)), $TM_{020}$ mode (FIG. 2(*b*)), and $TM_{030}$ mode (FIG. 2(*c*)).

Figure 3A:
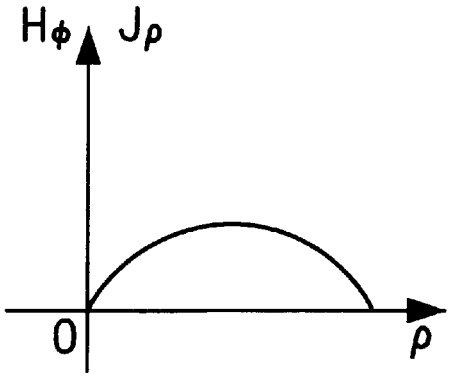
FIG. 3a (PRIOR ART)
FIGS. 3(*a*)–3(*c*) are graphic representations of the current and the magnetic field distributions of a typical prior art circular-shape resonator, operating in the $TM_{010}$ mode , $TM_{020}$ mode, and $TM_{030}$ mode as shown in FIG. 3(*a*), FIG. 3(*b*), and FIG. 3(*c*), respectively.
Figure 3B:
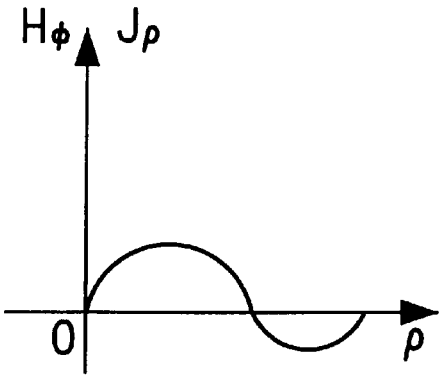
FIG. 3b (PRIOR ART)
Figure 3C:
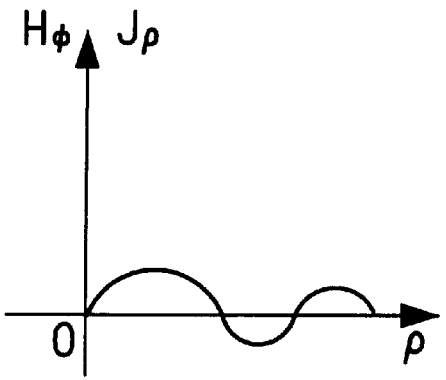
FIG. 3c (PRIOR ART)

Circular planar HTS $TM_{010}$ mode resonators, where i is a whole integer≧1, are known in the art. FIGS. 3(*a*)–3(*c*) are graphic representations of the radial direction current Jρ and the circular direction magnetic field Hϕ as functions of the radial distance ρ from the center of a typical circular HTS resonator of the prior art operating in the $TM_{010}$ mode , $TM_{020}$ mode, and $TM_{030}$ mode, shown in FIG. 3(*a*), FIG. 3(*b*), and FIG. 3(*c*), respectively. By comparing the Jρ, Hϕ versus ρ curves in FIGS. 2(*a*), 2(*b*) and 2(*c*) to those in FIGS. 3(*a*), 3(*b* and 3(*c*), it can be seen that the resonators with a central aperture (FIGS. 2(*a*), 2(*b*) and 2(*c*) have a region corresponding to the central aperture which is free of the resonator's fields and that the electromagnetic fields are confined within the HTS pattern.

Figure 4B:
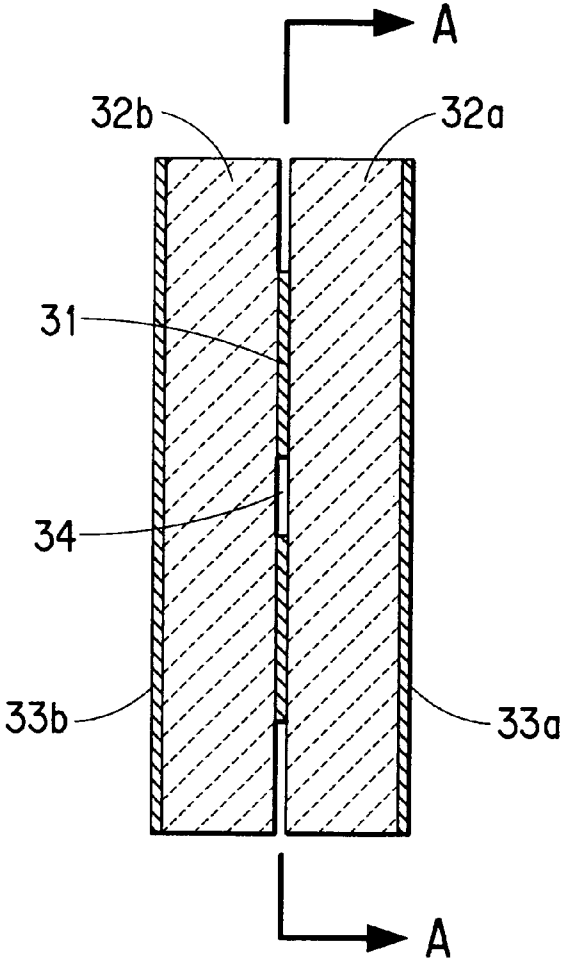
FIGS. 4(*a*)–4(*b*) are schematic illustrations of another embodiment of the resonator of this invention in the strip line configuration, in which FIG. 4(*a*) shows the A—A cut view and FIG. 4(*b*) shows the cross sectional view.
Figure 4A:
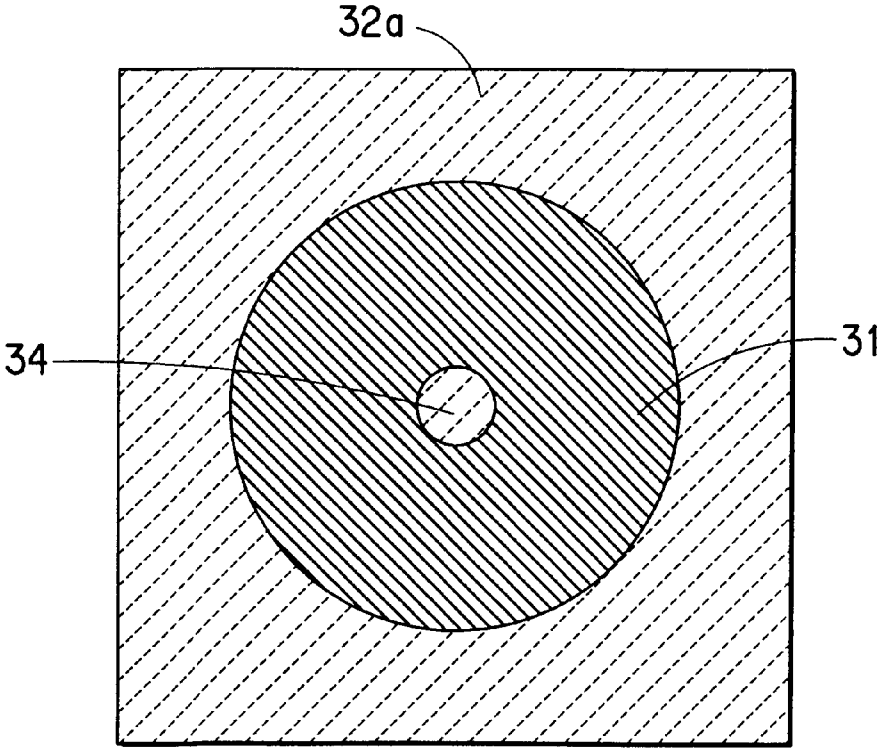

FIGS. 4(*a*)–4(*b*) show another embodiment of the circular resonator in the strip line configuration. As seen therein, the resonator in this embodiment comprises a circular HTS film 31 having a central aperture 34 therein sandwiched between substrates 32*a*, 32*b*, (see FIG. 4(*b*)) each substrate further comprising an HTS ground plate 33*a*, 33*b*, (see FIG. 4(*b*)) respectively.

Figure 5B:
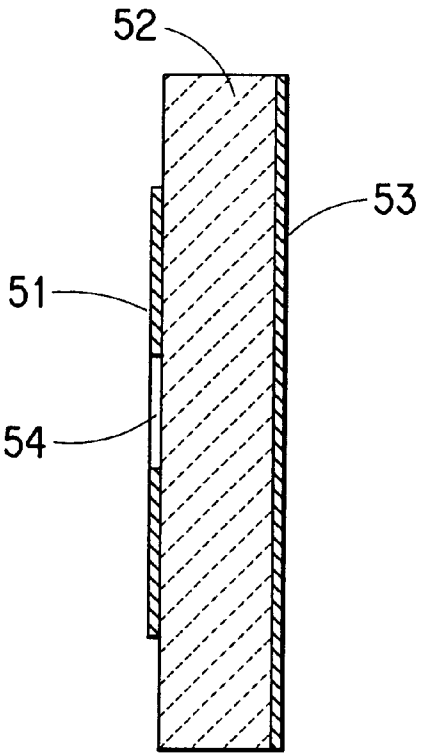
FIGS. 5(*a*)–5(*b*) are schematic illustrations of an octagon shape HTS planar resonator of this invention in the microstrip line configuration, in which FIG. 5(*a*) shows the front view and FIG. 5(*b*) shows the cross sectional view.
Figure 5A:
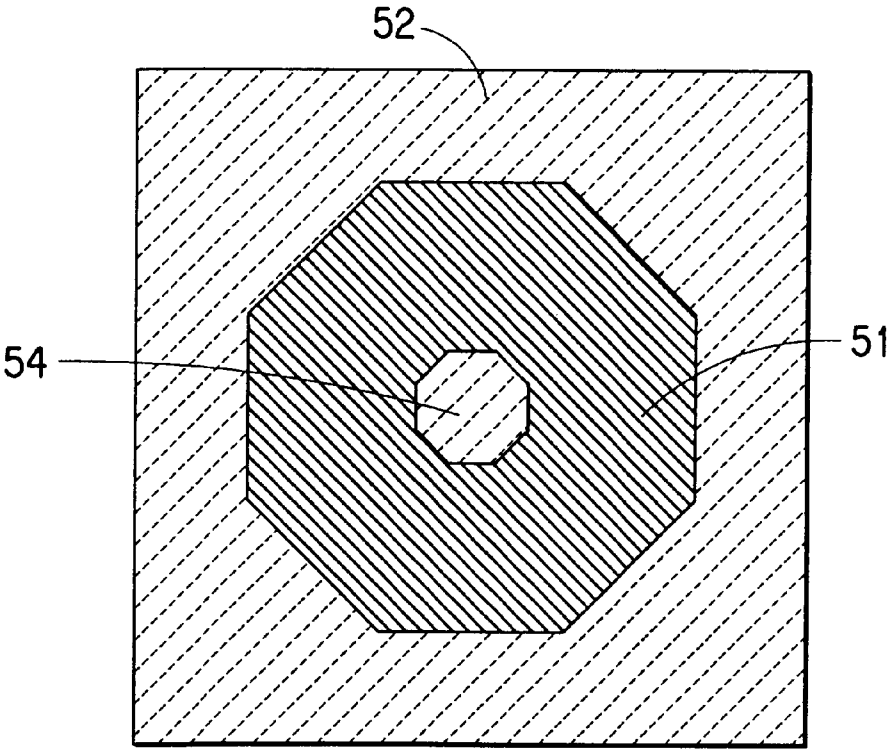

FIGS. 5(*a*)–5(*b*) illustrate an embodiment of the resonators of this invention, wherein an octoganal HTS film 51 having an octoganal central aperture 54 therein and an HTS ground plate 53 (see FIG. 5(*b*)) are deposited on opposite sides of a substrate 52.

Figure 6B:
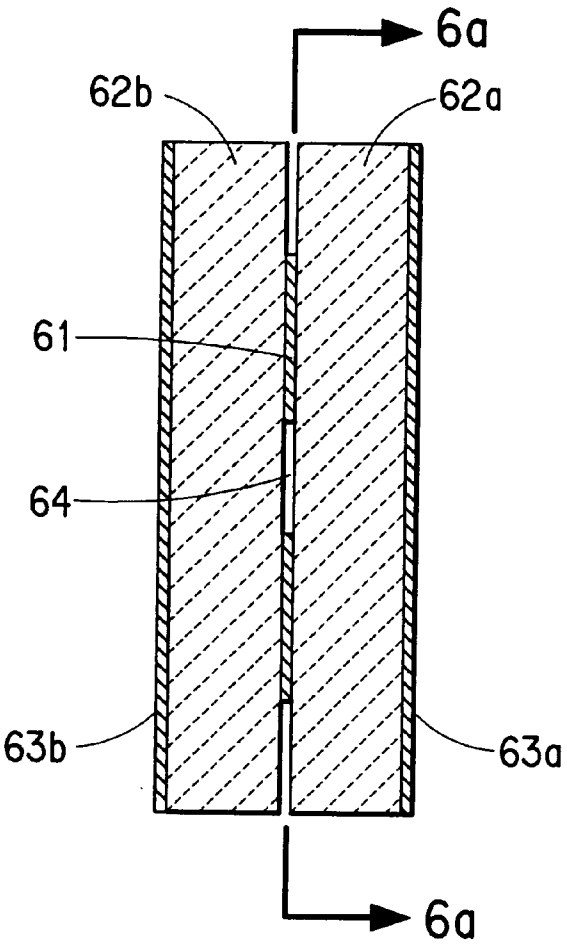
FIGS. 6(*a*)–6(*b*) are schematic illustrations of another embodiment of the octagon shape resonator of this invention in the strip line configuration, in which FIG. 6(*a*) shows the A–A cut view and FIG. 6(*b*) shows the cross sectional view.
Figure 6A:
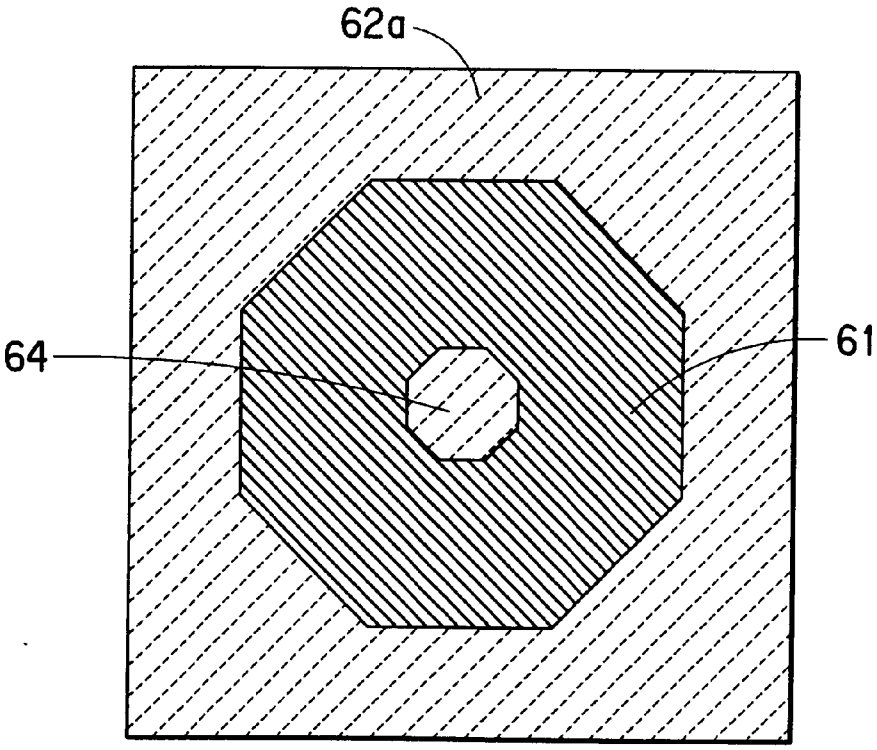

Yet another embodiment of the resonators of this invention are shown in FIGS. 6(*a*) and 6(*b*). In this embodiment, also in strip line configuration similar to the embodiment shown in FIGS. 4(*a*) and 4(*b*), the resonator comprises an octogonal HTS film 61 having an octogonal aperture 64 therein sandwiched between two substrates 62*a* and 62*b*, (see FIG. 6(*b*)) each substrate 62*a*, 62*b* having an ground plate 63*a*, 63*b*, (see FIG. 6(*b*)) respectively, deposited thereon.

Figure 7C:
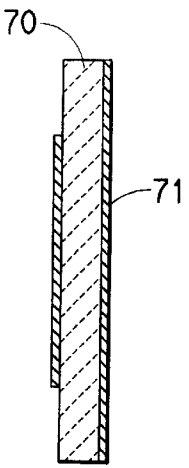
FIGS. 7(*a*)–7(*c*) are schematic illustrations of a 3-pole HTS filter having a $TM_{010}$ mode resonator of this invention as a frequency tuning device, in which FIG. 7(*a*) shows the front view, FIG. 7(*b*) shows cross sectional view, and FIG. 7(*c*) shows the back view.
Figure 7A:
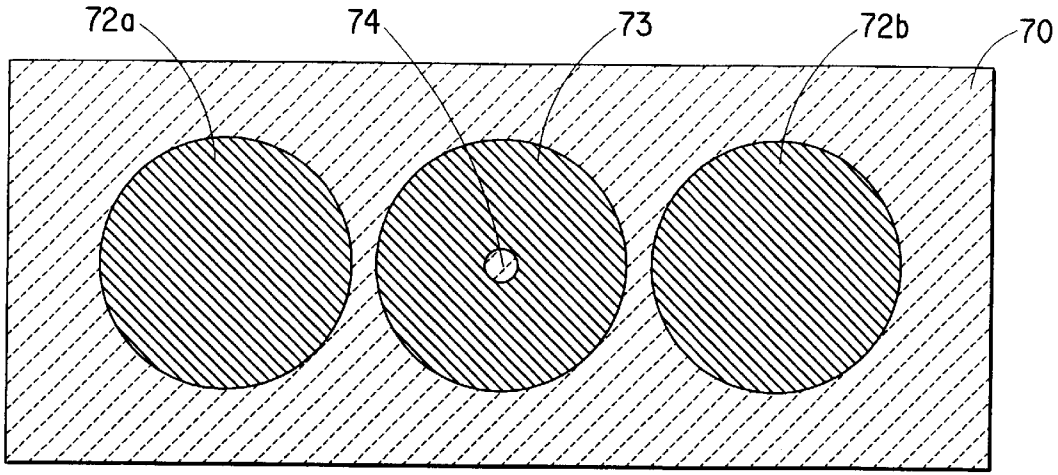
Figure 7B:
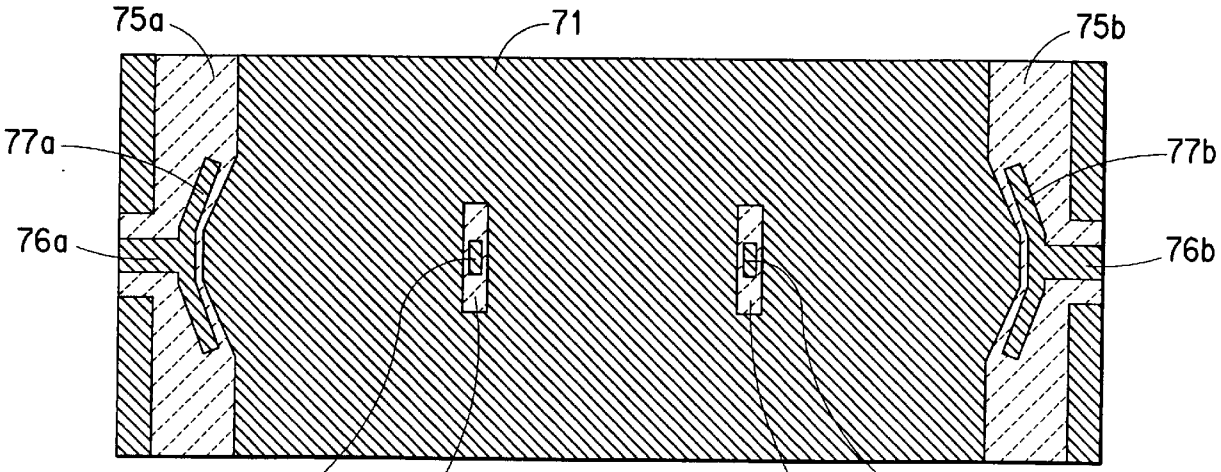

FIGS. 7(*a*), 7(*b*), and 7(*c*) illustrate a $TM_{010}$ mode HTS high power 3-pole filter incorporating a resonator of this invention therein. As seen in FIGS. 7(*a*) and 7(*b*), the 3-pole filter comprises a substrate 70 (see FIGS. 7(*a*) and 7(*b*) having a plurality of HTS films 72*a*, 73, 72*b* deposited on one side thereof and an HTS ground plate 71 (see FIGS. 7(*b*) and 7(*c*)) deposited on the opposite side thereof (see FIG. 7(*b*)). In the embodiment shown, films 72*a* and 72*b* represent prior art circular HTS resonators and film 73, having central aperture 74 therein, (see FIG 7(*a*)) represents a resonator of this invention.

With particular reference to FIG. 7(*c*), the input coupling circuit for the filter comprises an opening 75*a* in the ground plate 71 to provide room for the remaining coupling circuits, an input center line 76*a* in the coplanar line form, and a branch line 77*a* coupled to resonator 72*a* (see FIG 7*a*)). The output coupling circuit comprises an opening 75*b* in the ground plate 71 to provide room for the remaining coupling circuits, an output center line 76*b* in the coplanar line form, and a branch line 77*b* coupled to resonator 72*b*(see FIG. 7(*a*)). The inter-resonator coupling circuits comprises two openings 78*a* and 78*b* in the ground plate 71, and two coupling center lines 79*a* and 79*b* in the coplanar line form to provide coupling resonator 72*a* to resonator 73, and resonator 73 (see FIG. 7(*a*)) to resonator 72*b*, (see FIG. 7(*a*)) respectively.

For a 3-pole filter, the resonant frequency of three resonators comprising the filter must be precisely equal to their designed values. In reality, the resonant frequency can vary due to many uncontrollable factors. Therefore, it is very desirable to have some means to tune the resonant frequency of individual resonator. It is known, for example, that changing the radius of a prior art circular HTS resonator will chnage its frequency, but it is very difficult to change the radius, and thus tune the frequency, of a circular resonator after it has been fabricated.

In the embodiment of the 3-pole filter shown in FIGS. 7(*a*)–7(*a*)), the resonator of this invention comprises means for tuning the resonant frequency of the filter. In particular, the frequency of a circular resonator, according to the present invention, can readily be increased by providing an aperture in the center of the resonator. This can be readily accomplished by use of a high power laser, photolithographic etching, or shadow mask etching.

Figures 8A, 8B, 8C, 8D, 8E, 8F:
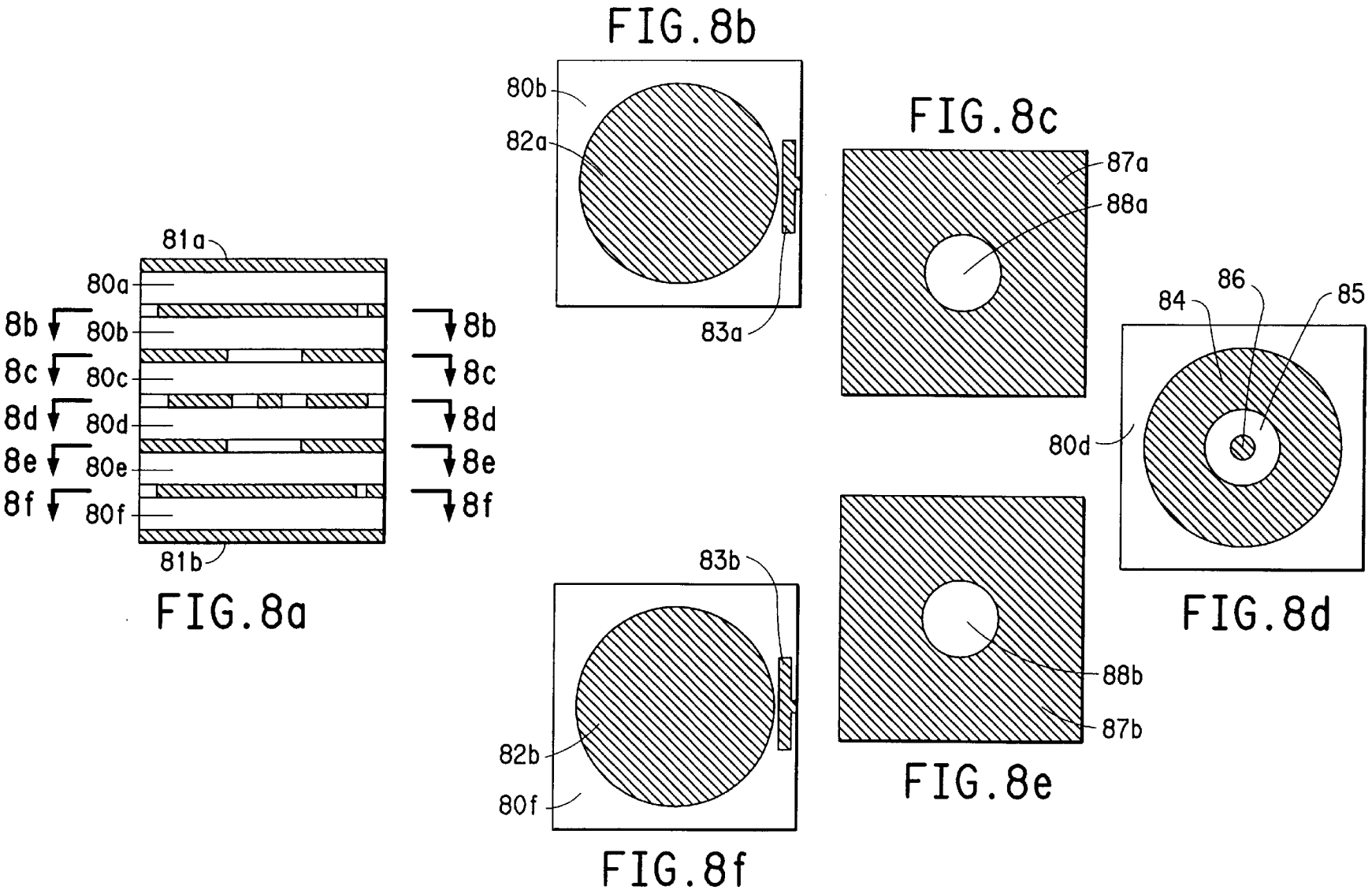
FIGS. 8(*a*)–8(*f*) are schematic illustrations of a 3-pole HTS filter in the stacked form having a $TM_{010}$ mode resonator of this invention for jump-over coupling between non-adjacent resonators, in which FIG. 8(*a*) shows the cross sectional view, and FIGS. 8(*b*), 8(*c*), 8(*d*), 8(*e*), and 8(*f*) show the B—B, C—C, D—D, E—E, and F—F cut views, respectively.

FIGS. 8(*a*)–8(*f*) illustrate yet another 3-pole $TM_{010}$ mode (i=1, 2, 3, . . . ) HTS filter having a stacked configuration which incoporates the resonator of this invention. The 3-pole filter is divided into three sections: the input section, the middle section and the output section.

The input section comprises an HTS circuit (see FIG. 8(*b*)) sandwiched between substrate 80*a* (having ground plate 81*a* deposited on one side thereof) and substrate 80*b*(see FIG. 8(*b*)). With reference to FIG. 8(*b*), the HTS circuit comprises a circular HTS resonator 82*a* and an input coupling circuit 83*a* deposited on substrate 80*b*. The middle section comprises the HTS circuit pattern shown in FIG. 8(*d*) sandwiched between two substrates, 80*c*, 80*d* (see FIG. 8(*a*)). The circuit pattern for the middle section, shown in FIG. 8(*d*), comprises an HTS resonator 84 having aperture 85 in the center thereof and a circular HTS dot 86 concentric with aperture 85 and resonator 84 deposited on substrate 80*d*. The output section comprises an HTS circuit (see FIG. 8(*f*)) sandwiched between substrates 80*f* (having ground plate 81*b* deposited on one side thereof) and substrate 80*e* (see FIG. 8(*a*)). The HTS circuit for the output section, shown in FIG. 8(*f*), comprises a circular HTS resonator 82*b* and an output coupling circuit 83*b* deposited on substrate 80*f*. The HTS ground plate 87*a* having center coupling means 88*a* (see FIG. 8(*c*)) separates the input section and middle section. A simliar ground plate 87*b* having center coupling means 88*b* (see FIG. 8(*e*)) separates the middle section and the output section. In this respect, the ground plate 87*a* has shared functionality between the input section and the middle section and ground plate 87*b* has shared functionality between the middle section and the output section. Coupling means 88*a* provides coupling between resonator 82*a* and resonator 84, whereas coupling means 88*b* provides coupling between resonator 84 and resonator 82*b*. In addition, coupling means 88*a* and 88*b*, together with aperture 85 in resonator 84, provide coupling between resonator 82*a* and resonator 82*b*, as explained more fully below.

With particular reference being made again to FIG. 8(*d*), the resonator 84 having central aperture 85 comprises means for coupling between resonator 82*a* and resonator 82*b*. It will be appreciated that such coupling is aptly referred to as "jump-over" coupling because resonators 82*a* and 82*b* are not adjacent to one another, but in fact are separated by intermediate resonator 84. Thus, coupling from resonator 82*a* to resonator 82*b* requires a "jump" over the intermediate resonator 84. This "jump-over" coupling application of the present invention is particularly advantageous for use in elliptical frequency response filters, which in turn have the advantage of having very steep skirts.

As noted earlier with reference to FIG. 2, the electromagnetic field of the $TM_{010}$ mode (i=1, 2, 3, . . . ) in the resonator are confined to the HTS film itself and the central aperture in the resonator is free of electromagnetic fields generated by the resonator. This "free space" is thus available for use in coupling non-adjacent resonators. With particular reference to the stacked filter shown in FIG. 8(*a*)–8(*f*), the electromagnetic fields are confined within the area of the HTS film 84 and the central aperture 85 provides a space free of electromagnetic fields, which can be used as the space for the "jump-over" coupling between resonators 82*a* and 82*b*, through the coupling means 88*a* on ground plate 87*a* (see FIG. 8(*c*)) and coupling means 88*b* on ground plates 87*b* (see FIG. 8(*e*)). The concentric HTS dot 86 in aperture 85 (see FIG. 8(*d*)) provides another dimension to vary the coupling strength among these resonators. In summary, the coupling strength between and among resonator 82*a*, 84 and 82*b*, can be adjusted by varying the diameter of coupling means 88*a* and 88*b*, the aperture 85, and the HTS dot 86.

EXAMPLE

Figure 9A:
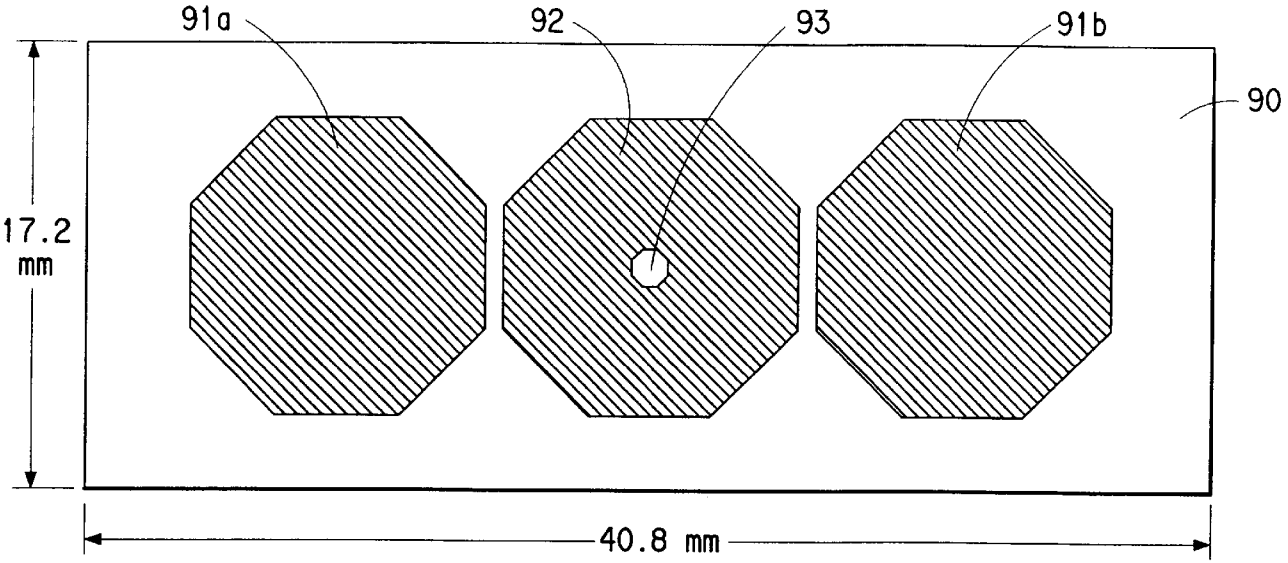
FIGS. 9(*a*)–9(*b*) are schematic illustrations of a high power 3-pole HTS filter having a $TM_{010}$ mode resonator of this invention as a frequency tuning device, in which FIG. 9(*a*) is a front view thereof and FIG. 9(*b*) is a back view thereof.
Figure 9B:
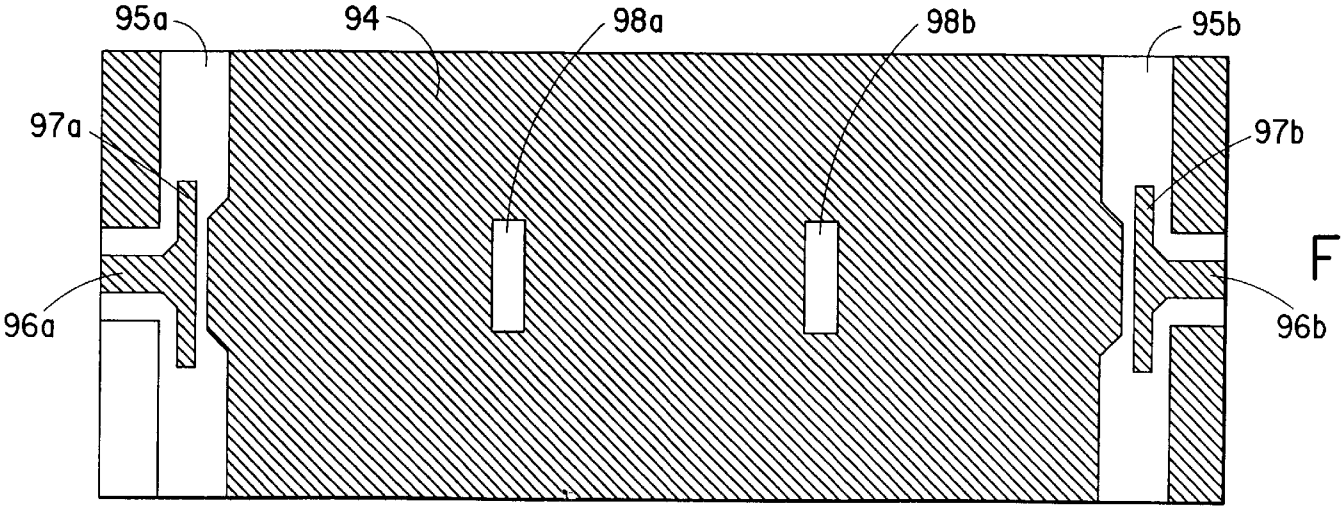

A high power 3-pole $TM_{010}$ mode HTS filter was prepared by depositing double-sided $Tl_2Ba_2CaCu_2O_8$ HTS thin films on both sides of a 40.8 mm×17.2 mm×0.508 mm $LaAlO_3$ substrate. Using a standard bi-level photolithographic process and ion beam milling, a filter having the structure shown in FIGS. 9(*a*) and 9(*b*) was prepared, (with particular reference to FIG. 9(*a*)) in which 90 is the substrate; 91*a* and 91*b* are octagonal shaped resonators; 92 is an octagonal shaped resonator having a central aperture 93 therein; and (with particular reference to FIG. 9(*b*)) 94 is the ground plate; opening 95*a*, coplanar center line 96*a* and T-type coupling branch line 97*a* collectively form the input coupling circuit; opening 95*b*, coplanar center line 96*b* and T-type coupling branch line 97*b* collectively form the output coupling circuit; and openings 98*a* and 98*b* comprise the inter-resonator coupling circuits.

Figure 10:
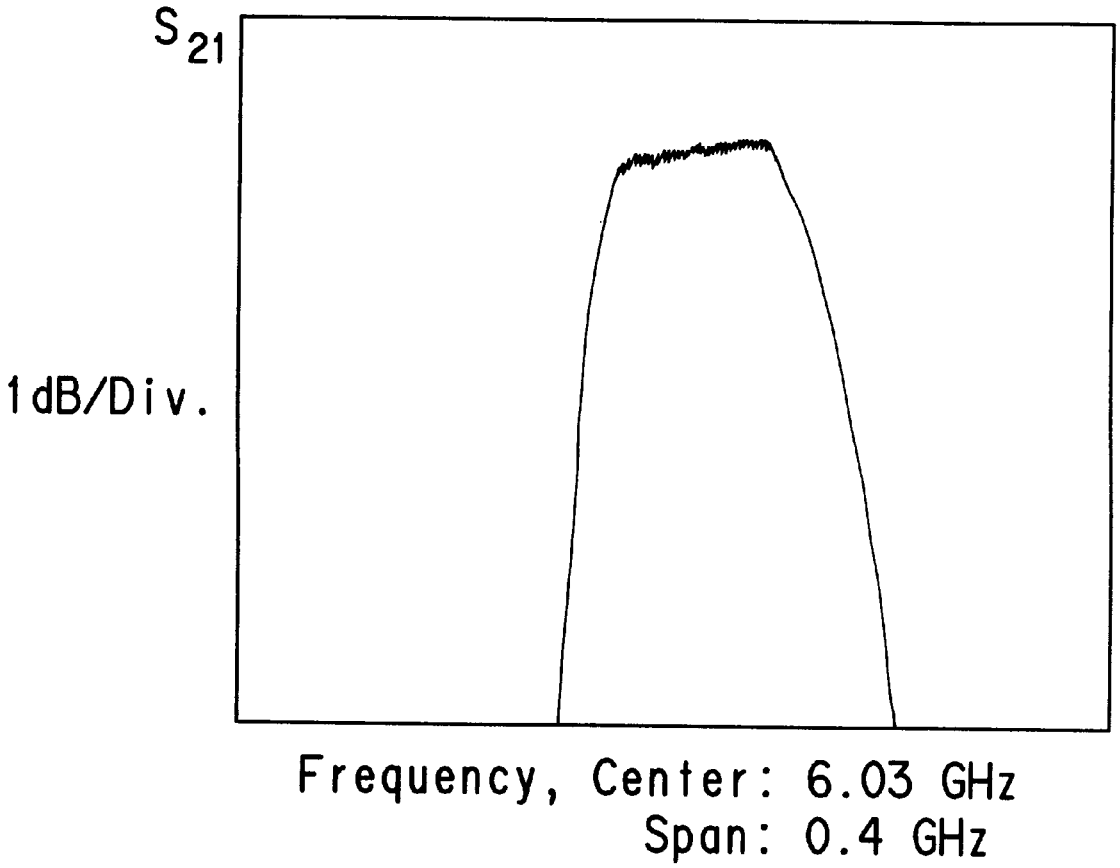
FIG. 10 is a graph of the $S_{21}$ versus frequency response curves for the HTS filter of FIGS. 9(*a*)–9(*b*) at six different transmitting power levels.

The filter was housed in a copper case with SMA compatible input and output connectors and the filter was tested at 77° K. The diameter of central aperture 93 in resonator 92 (see FIG. 9(*a*)) was increased (using photolithography ion beam milling) in 24-micron incriments until optimum performance was obtained. The filter was then tested at power levels of 1.7 watts, 20 watts, 40 watts, 50 watts 62 watts and 74 watts. The measured $S_{21}$ versus frequency response curves at all six power levels are shown in FIG. 10. As seen in FIG. 10, the six curves lay on top of one another without notable performance degradation, such that they are not individually discernible in the graph of FIG. 10 even in the fine vertical scale of 1 dB/Div.

What is claimed is:

1. A $TM_{0i0}$ mode planar high temperature superconductor resonator, where i is a whole integer≧1, in a microstrip line form comprising a shaped high temperature superconductor film and at least one high temperature superconductor ground plate deposited on opposite sides of a dielectric substrate, said shaped high temperature superconductor film has an aperture in a center thereof and said shaped high temperature superconductor film has a shape of a polygon and said aperture comprises means for frequency tuning the resonator, wherein the polygon shaped high temperature superconductor film has an octagon shape.

2. A $TM_{0i0}$ mode planar high temperature superconductor resonator, where i is a whole integer≧1, in a microstrip line form comprising a shaped high temperature superconductor film and at least one high temperature superconductor ground plate deposited on opposite sides of a dielectric substrate; wherein said shaped high temperature superconductor film has an aperture in a center thereof and said shaped high temperature superconductor film has a shape of a polygon and said aperture comprises means for frequency tuning the resonator, said resonator further comprising a second high temperature film concentrically located relative to the aperture in the center of the shaped high temperature superconductor film.

3. A $TM_{0i0}$ mode planar high temperature superconductor resonator, where i is a whole integer≧1, in a strip line form comprising, in order, (a) a first high temperature superconducting ground plate;

(b) a first dielectric substrate being desposited upon said ground plate;

(c) a shaped high temperature superconductor film being deposited upon said first dielectric substrate;

(d) a second dielectric substrate being deposited upon said superconductor film; and (e) a second high temperature superconductor ground plate being deposited upon said second dielectric substrate;

wherein said shaped high temperature superconductor film has an aperture in a center thereof and said shaped high temperature superconductor film has a shape of a polygon, and said aperture comprises means for frequency tuning the resonator, wherein the polygon shaped high temperature superconductor film has an octagon shape.

4. A $TM_{0i0}$ mode planar high temperature superconductor resonator, where i is a whole integer≧1, in a strip line form comprising, in order:

(a) a first high temperature superconducting ground plate;

(b) a first dielectric substrate being deposited upon said ground plate;

(c) a shaped high temperature superconductor film being deposited upon said first dielectric substrate;

(d) a second dielectric substrate being deposited upon said superconductor film; and (e) a second high temperature superconductor ground plate being deposited upon said second dielectric substrate;

wherein said shaped high temperature superconductor film has an aperture in a center thereof and said shaped high temperature superconductor film has a shape selected from the group consisting of a circle and a polygon, and wherein said aperture comprises means for frequency tuning the resonator, said resonator further comprising a second high temperature film concentrically located relative to the aperture in the center of the shaped high temperature superconductor film.

* * * * *